US005829529A

United States Patent [19]

Cholet et al.

[11] Patent Number: 5,829,529

[45] Date of Patent: Nov. 3, 1998

[54] METHOD AND DEVICE FOR PRODUCING BY PUMPING IN A HORIZONTAL DRAIN HOLE

[75] Inventors: Henri Cholet, Le Pecq; Christian Wittrisch, Rueil Malmaison, both of France; Jack Bootsman, Lloydminster, Canada

[73] Assignee: Institut Francais de Petrole, France

[21] Appl. No.: 752,936

[22] Filed: Nov. 20, 1996

[30] Foreign Application Priority Data

Nov. 21, 1995 [FR] France ..... 95 13804

[51] Int. Cl.[6] ..... E21B 43/12; E21B 43/38

[52] U.S. Cl. ..... 166/369; 166/105.5

[58] Field of Search ..... 166/250, 105, 166/105.1, 105.5, 311, 242.1, 242.8, 369

[56] References Cited

U.S. PATENT DOCUMENTS 4,878,539 11/1989 Anders ..... 166/303
5,085,275 2/1992 Gondouin ..... 166/303
5,450,902 9/1995 Matthews ..... 166/268

FOREIGN PATENT DOCUMENTS 0 435 716 7/1991 European Pat. Off. .
0 465 316 1/1992 European Pat. Off. .
0 484 207 5/1992 European Pat. Off. .
2 692 320 12/1993 France .

*Primary Examiner*—David J. Bagnell
*Attorney, Agent, or Firm*—Millen, White, Zelano & Branigan, P.C.

[57] ABSTRACT

The present invention relates to a pumping method and device in a well comprising a portion that is greatly inclined with respect to the vertical. A pump is secured to a strong of tubes that are lowered into the well. Suction devices are set into the greatly inclined well portion at the lower end of the pumping means. At least one suction port is placed laterally with respect to the suction devices and in a single direction. The direction of the port is oriented so that it is substantially opposite a lower generating line of the well. In a variant, the suction devices comprise an articulated body that can place the port opposite the lower generating line of the well.

9 Claims, 4 Drawing Sheets

32
25
26
30
22
33
31
28
29
23
24
21
15
27
II C
II B 37
25
26
30
22
28
29
35
39
40
41
42
43
36
31
34
32
23
15
27
38
IIIC
IIIB

METHOD AND DEVICE FOR PRODUCING BY PUMPING IN A HORIZONTAL DRAIN HOLE

FIELD OF THE INVENTION

The present invention relates to a method and to a device for producing hydrocarbons by pumping in a substantially horizontal drain hole. The drain hole is drilled in a hydrocarbon reservoir along a trajectory comprising at least one portion that is greatly inclined with respect to the vertical.

The present invention applies to cases where the hydrocarbons drained by the horizontal drain hole contain a proportion of gas that can be significant in relation to the liquid phase, more or less viscous. In this case, pumping of a two-phase effluent can have a low efficiency.

BACKGROUND OF THE INVENTION

It is well-known to set a static separator in a part of the inclined drain hole, but the pumping efficiency is not really improved because the level difference between the inlet and the outlet of the separator is low and the separator can generate pressure drops prejudicial to the pumping efficiency and to the separating action. Furthermore, when the dynamic level of the effluent is low in relation to the inclined well portion, setting the pump and the separator is practically impossible in too inclined a zone.

The present invention can preferably relate to all the drain holes in which the effluent is a multiphase effluent and flows through the drain hole in a stratified flow, i.e., in case of gas and liquid, the gas fills the upper part of the drain hole whereas the oil flows at the bottom of the substantially horizontal drain hole.

SUMMARY OF THE INVENTION

The present invention thus relates to a pumping method in a well comprising a portion greatly inclined with respect to the vertical, in which pumping means secured to a string of tubes are lowered into said well, the string is held at the ground surface by suspension means, suction means are placed at the lower end of the pumping means. In the method, the following stages are performed:

at least one suction port is placed laterally with respect to said suction means and in a single direction, said suction means are substantially placed in said greatly inclined portion, the direction of said port is so oriented that it is substantially opposite a lower generating line of said well.

According to the method, said port can be oriented by rotation of the string of tubes from the ground surface, said string driving the pumping means and the suction means into the same rotating motion.

The orientation of the ports can be controlled by performing surface measurements on the effluent delivered by said pumping means.

A product can be injected from the ground surface substantially at the level of the suction port.

The invention further relates to a pumping device in a well comprising a portion that is greatly inclined with respect to the vertical, said device includes pumping means secured to a string of tubes, suspension means for suspending the string to the ground surface, suction means placed at the lower end of the pumping means. The suction means comprise at least one suction port oriented laterally with respect to said suction means and in a specific direction.

The port can be situated on a body and said body can comprise at least one rotating link so that it can rotate in relation to said pumping means.

The body can comprise orienting means suited to place substantially said port opposite a lower generating line of the inclined well portion.

The orienting means can comprise magnets placed laterally with respect to said port.

The suction means can comprise means for injecting a fluid substantially in the neighbourhood of the port.

The injection means can comprise a swivel linked to said body by means of a rotating link.

BRIEF DESCRIPTION OF THE DRAWINGS

Other features and advantages of the invention will be clear from reading the description hereafter, given by way of non limitative examples, with reference to the accompanying drawings in which.

DESCRIPTION OF THE PREFERRED EMBODIMENTS

Figure 1:
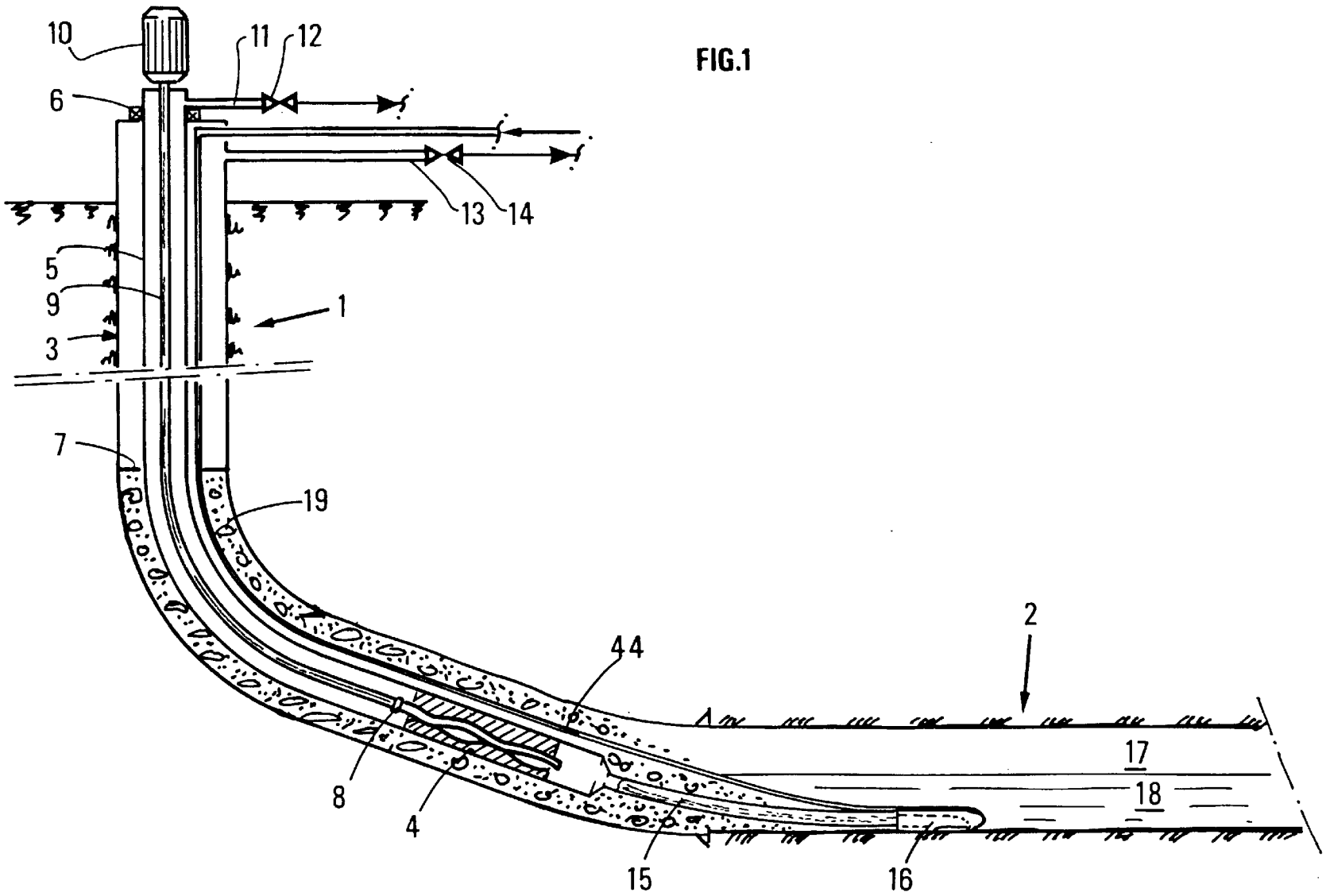
FIG. 1 diagrammatically shows the device set in a production well.

FIG. 1 is a sectional view of a well 1 drilled from the ground surface with a substantially vertical part then an inclined part that substantially reaches a horizontal position in the reservoir bed containing the hydrocarbons. A casing 3 is set in the well generally in order to cover the formation from the surface to the inlet of the pay zone. Pumping means 4, for example a Moineau type positive-displacement pump, are lowered into the well through a string of tubes 5 held at the well head by suspension means 6. Pump 4 is generally positioned below the dynamic level 7 of the effluent filling well 1. In the example shown here, the pump includes a rotor 8 driven in rotation by a string 9 of pipes or tubes, said string being driven in rotation by mechanical surface means 10.

Casing 3 comprises a lateral line 13 controlled by a valve 14. The gas that is collected in the inner space of this string 3 can be discharged through lateral line 13.

The string of tubes 5 also comprises at the surface a flowline 11 for delivering the production drawn off by pump 4. A valve 12 controls the flow.

The suction line of the pump is extended by a tail pipe 15 so as to be able to position the suction point or points in the optimum place in the horizontal drain hole in order to obtain the best production efficiency. Tail pipe 15 can comprise, at the end thereof, a head 16 whose port or ports are arranged in a preferred direction in relation to the axis of the drain hole.

In FIG. 1, the effluent is shown in a stratified flow: the gas 17 is in the upper part of drain hole 2, above the liquid phase of the hydrocarbons. In the well part that is less inclined with respect to the vertical, the stratified flow is generally disturbed, for example, by the sucking action of the pump, by the presence of the pump or of tubes that reduce the annular space and of course by the action of gravity. The gas can re-form as bubbles or plugs 19.

Suction head 16 can comprise at least one opening situated along a generating line of the tube so that the orientation of said generating line around the axis thereof allows to direct and to place the suction opening as close as possible to the lower generating line of the horizontal drain hole. The suction point will thus be at the furthest distance from the gas possibly accumulated in the upper part of the drain hole. The suction opening can be made up of one or several cylindrical holes lined up on the same generating line, or of an oblong opening lined up on a generating line.

In a first embodiment of the invention, tail pipe 15 and possibly the suction head are secured to the stator of the pump, which is secured to the string of tubes 5. Furthermore, the suspension means 6 intended to hold string 5 at the well head comprise rotation means equivalent to a rotary table, so as to be able to rotate the whole of string 5 about its axis, while driving in the same motion the stator of the pump, tail pipe 15 and suction head 16 into rotation. It is thus possible, from the surface, to shift in rotation the suction openings so as to position them as low as possible in the horizontal drain hole. Measuring devices of the pendulum type can be used to locate the position of said openings. These devices are not described here since they are well-known and already used by technicians to orient an instrument in a well, for example a bent sub.

Another method for checking the optimum lower position of the suction openings consists in controlling the proportion of gas carried along by the effluent delivered by the pump (GOR or gas/oil ratio) for several orientations of the openings, these orientations being obtained with the aid of means 6. The orientation providing the lowest proportion of gas will be selected if this is the desired result.

In certain well configurations, it is difficult or at least dangerous to turn the whole of string 5 round on itself It will generally be the case in deflected wells with a small bending radius where frictions can exceed the torsional strength of the tubes. It is then advantageous to use a suction head 16 according to FIGS. 2A, 2B and 2C.

Figures 2A, 2B, 2C:
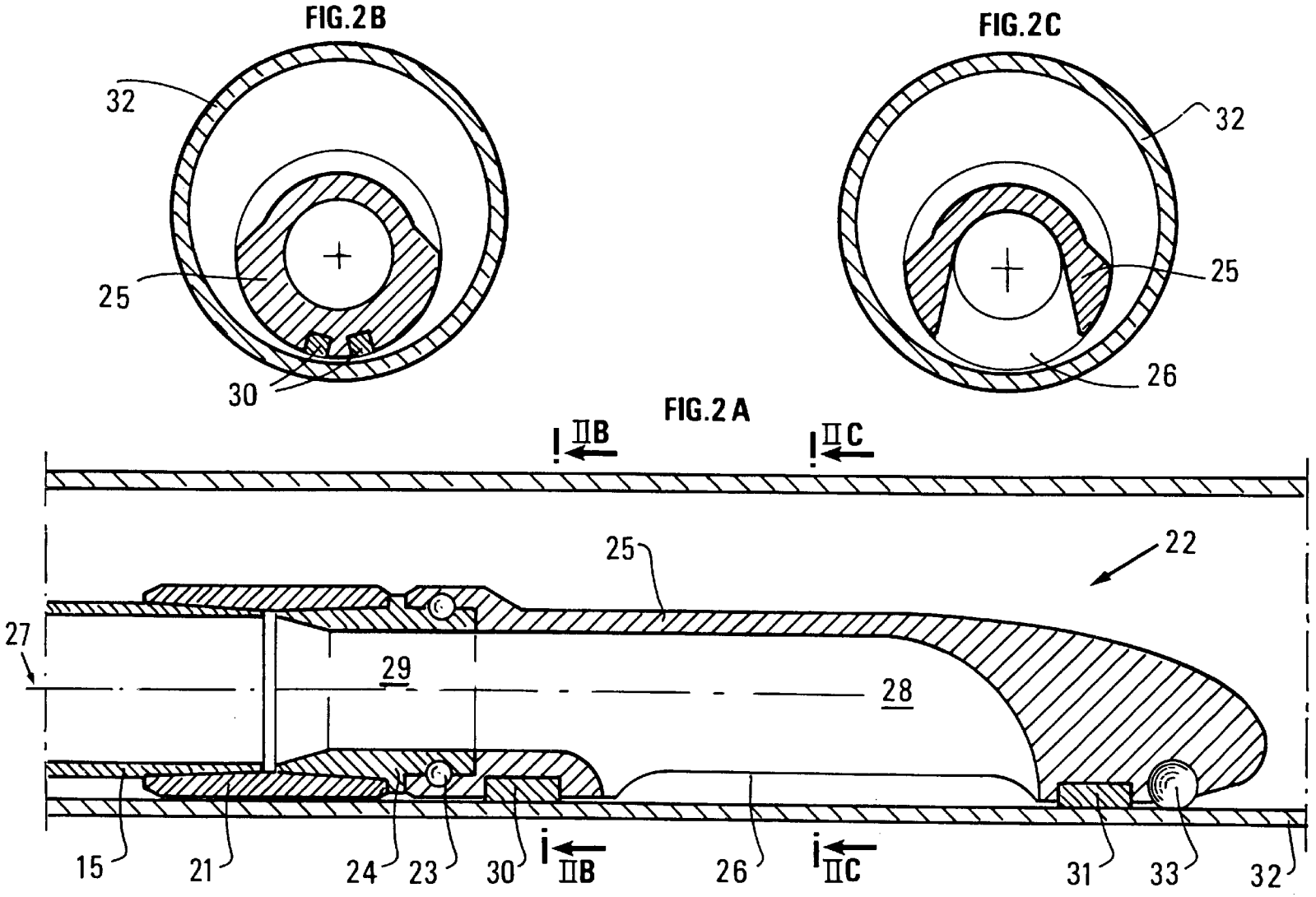
FIG. 2A is a lengthwise section of a particular embodiment of the invention.
FIGS. 2B and 2C are cross-sections along lines I—I and II—II, respectively of the embodiment according to FIG. 2A.

FIG. 2A is a sectional view of the end of tail pipe 15 screwed, by means of a conventional sub 21, onto suction head 22. Suction head 22 is mainly made up of a fastening sub 24 suited to be screwed onto sub 21 and of a body 25 linked to fastening sub 24 by a rotating link 23. Body 22 can thus freely rotate about axis 27. Body 25 comprises a line 28 that extends the inner space 29 of tail pipe 15. Line 28 ends with a lateral opening 26 of elongate shape in the direction of a generating line. The width of the opening is illustrated in FIG. 2C.

Body 25 also comprises a series of magnets 30 and 31 respectively placed before and behind opening 26 and along substantially the same generating line as the opening.

FIG. 2B is a sectional view of the circumferential position of the magnets.

FIG. 2C is a sectional view of the shape that lateral opening 26 may exhibit, and of its position in relation to tube 32 that covers the horizontal drain hole. Of course, this tube (generally referred to as liner) is perforated over the total length of the drain hole so that the effluent contained in the reservoir rock can flow into the drain hole.

The working principle of suction head 22 consists in taking up a specific orientation by itself so that opening 26 is turned towards the bottom of liner 32, i.e. at a greater distance from the gas accumulated in the upper part of the liner. The suction means are placed in the greatly inclined portion of the well and they therefore rest on the bottom of the drain hole, i.e. substantially in contact with the lower generating line of the drain hole. Orientation of the opening is notably obtained through the action of gravity and by means of rotating link 23. Body 25 is so machined that its center of gravity is below axis 27, and the machining of body 25 providing masses on either side of the opening can be clearly seen in FIGS. 2B and 2C. To complete the action of gravity, magnets 30 and 31 tend to bring body 25 into rotation about its axis in order to decrease the dimension of the air gap consisting of the magnets and of the inner wall of liner 32. Of course, liner 32 will be made of a magnetic material.

A means 33 facilitating the longitudinal and transverse sliding of the body on the wall of the liner can be placed at the end of body 25.

Figures 3A, 3B, 3C:
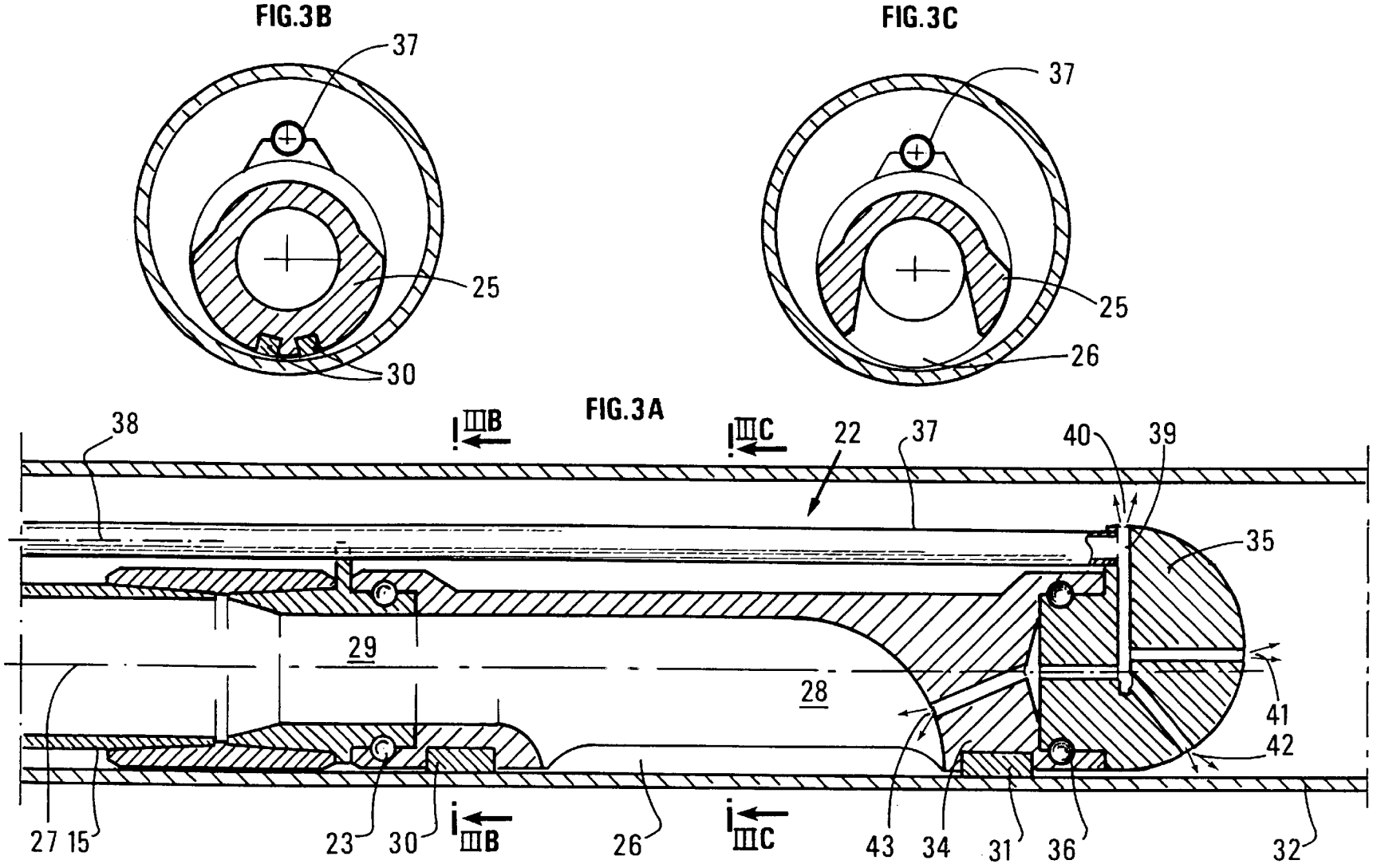
FIG. 3A is a lengthwise section of another embodiment of the invention.
FIGS. 3B and 3C are cross-sections along lines III—III and IV—IV, respectively of the embodiment according to FIG. 3A.

FIGS. 3A, 3B and 3C illustrate a variant of the embodiment of FIG. 2 where means for injecting a product, for example a product for thinning the liquid hydrocarbon, have been added. This injection is performed substantially in the neighbourhood of the suction port, at the level of the suction head. Suction head 22 comprises a body 34 that is fastened to tail pipe 15 in the same way as shown in FIG. 2A. The inner line 28 and the lateral opening 26 can be similar to the previous embodiment. Magnets 30 and 31 can also be arranged in the same way and they fulfil the same function.

At the end of body 34, an injection nozzle is assembled by means of a rotating link 36 that can be similar to link 23. Injection nozzle 35 is fastened in rotation to tail pipe 15 by a tube 37. Tube 37 will preferably be made from a nonmagnetic material in order not to disturb the action of the magnets intended to orient opening 26 by rotating body 34. The inner line 38 of tube 37 communicates with a series of channels 39 drilled in nozzle 35. Channels 39 end in injection ports 40, 41, 42 and 43. The layout of the injection ports can notably be defined by the nature of the viscous hydrocarbons, the presence, more or less considerable, of gas or the nature of the flow.

FIGS. 3B and 3C are sectional views of the position of tube 37.

It is thus possible to have an automatic-orientation suction head and a fluid injection system before the suction head.

Tube 37 is connected to the surface by a tube 44 (FIG. 1) placed in the annulus defined by strings 3 and 5. As the pumping device is lowered into the well, tube 44 is unwound or assembled in order to follow the lowering of the suction head. Tube 44 can be a metal tube of the coiled tubing type or a flexible tube made of composite.

Figure 4:
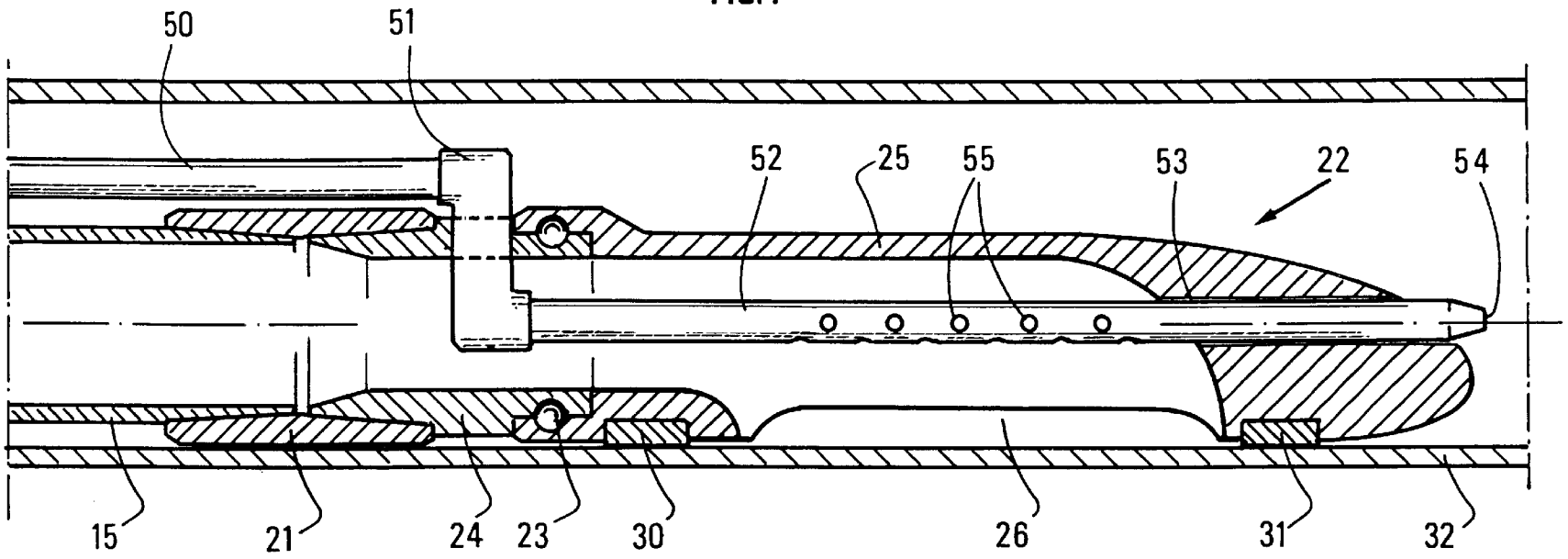
FIG. 4 shows a of the embodiment illustrated by FIG. 3A

FIG. 4 is a variant that is very close to that of FIG. 3A. The outside diameter of body 25 is so machined that suction head 22 overhangs in relation to tail pipe 15 and sub 21. In this variant, the diameter of sub 21 is widened so that body 25 is practically not in contact with the wall of the horizontal drain hole. The orienting means can be similar to those of the other variants. Furthermore, an injection tube 50 for injecting a thinning fluid flows from the annular space into the suction head by means of a tube joint 51. The tube is extended up to the end of the suction head by a tube portion 52 substantially placed longitudinally in line with body 25. Tube 52 runs through the nozzle of the suction head through an axial port 53. Tube 52 is ended by a spray tip 54 allowing a fluid to be injected at the front of the suction head. Other ports 55 are provided on the length of tube 52 so as to inject part of the thinning fluid at the level of opening 26. With such a layout, tube 52 is fixed with respect to tail pipe 15 while allowing body 25 to rotate freely about its axis.

We claim:

1. A pumping method in a well including a portion greatly inclined with respect to the vertical, wherein pumping means (4) secured to a string of tubes (5) are lowered into said well, the string being held at the ground surface by suspension mean (6) and suction means (15,16) being placed at the lower end of the pumping means, the method comprising:

placing at least one suction port (26) laterally with respect to said suction means and facing in a single direction, orienting said suction means substantially in said greatly inclined portion, orienting the direction of said port substantially opposite a lower generating line of said well by rotating the string of tubes (5) from the ground surface, and using the string to drive the pumping means and the suction means with the same rotating motion.

2. A method as claimed in claim 1, wherein orienting of the ports is controlled by performing surface measurements on the effluent delivered by said pumping means.

3. A method as claimed in claim 2, wherein a product is injected, from the ground surface, substantially at the level of the suction port.

4. A method as claimed in claim 1, wherein a product is injected, from the ground surface, substantially at the level of the suction port.

5. A pumping device in a well comprising a portion greatly inclined with respect to the vertical, said device comprises pumping means (4) secured to a string of tubes (5), suspension means (6) for suspending the string (5) from the ground surface, suction means (15,16) placed at the lower end of the pumping means, wherein said suction means comprise at least one suction port (26) oriented laterally with respect to said suction means in a specific direction, said suction port being placed on a body (25; 34) comprising at least one rotating link (23; 36) allowing the body to rotate relative to said pumping means (4), said body (25; 34) further comprising orienting means (30, 31) suited to substantially place said port opposite a lower generating line of the inclined well portion, and said orienting means comprising magnets placed laterally with respect to said port.

6. A device as claimed in claim 5, wherein the suction means comprise means (35) for injecting a fluid substantially in the neighbourhood of port (26).

7. A device as claimed in claim 6, wherein said injection means comprise a swivel (35) connected to said body by means of a rotating link (36).

8. A device as claimed in claim 5, wherein the suction means comprise means (35) for injecting a fluid substantially in the neighborhood of port (26).

9. A device as claimed in claim 8, wherein said injection means comprise a swivel (35) connected to said body by means of a rotating link (36).

* * * * *